US012070830B1

(12) United States Patent
Preimesberger et al.

(10) Patent No.: US 12,070,830 B1
(45) Date of Patent: Aug. 27, 2024

(54) AUTOMATED CATHODE BUFFING SYSTEM

(71) Applicant: CAID INDUSTRIES, INC., Tucson, AZ (US)

(72) Inventors: Neal J. Preimesberger, Tucson, AZ (US); Thomas G. Carmichael, Tucson, AZ (US)

(73) Assignee: Samuel, Son & Co. (USA) Inc., Woodridge, IL (US)

( * ) Notice: Subject to any disclaimer, the term of this patent is extended or adjusted under 35 U.S.C. 154(b) by 1080 days.

(21) Appl. No.: 16/713,567

(22) Filed: Dec. 13, 2019

Related U.S. Application Data

(60) Provisional application No. 62/783,542, filed on Dec. 21, 2018.

(51) Int. Cl.

| | |
|---|---|
| ***B24B 29/06*** | (2006.01) |
| ***B24B 7/26*** | (2006.01) |
| ***B24B 41/02*** | (2006.01) |
| ***B24B 55/06*** | (2006.01) |
| ***B24D 13/20*** | (2006.01) |
| ***C25C 7/06*** | (2006.01) |
| ***C25C 7/08*** | (2006.01) |

(52) U.S. Cl.
CPC ..... *B24B 29/06* (2013.01); *B24B 7/26* (2013.01); *B24B 41/02* (2013.01); *B24B 55/06* (2013.01); *B24D 13/20* (2013.01); *C25C 7/06* (2013.01); *C25C 7/08* (2013.01)

(58) Field of Classification Search
CPC ... B24B 27/0038; B24B 27/033; B24B 27/04; B24B 27/0069; B24B 27/0076; B24B 7/02; B24B 29/005; B24B 29/05; B24B 29/06; B24B 41/02; B24B 41/06; B24B 41/068; B24B 41/005; B24B 41/00; B24B 55/06; B24B 55/04; B24B 55/12; B24D 13/02; B24D 13/20; B24D 13/10; B08B 5/02; B08B 5/023; B08B 11/02; C25C 7/06; C25C 7/08; B23H 5/02; B23H 5/04; B23H 5/06; B23H 5/08
USPC ... 451/13, 23, 109, 212, 213, 200, 199, 194, 451/334, 393, 488, 908, 911, 914, 110, 451/190, 59, 236, 451, 453, 456; 15/77, 15/300.1, 3.53
See application file for complete search history.

(56) References Cited

U.S. PATENT DOCUMENTS 2,220,982 A * 11/1940 Toney ..... C25C 7/00 15/77
3,501,795 A * 3/1970 Jasberg ..... C25C 7/06 134/67
4,138,755 A * 2/1979 Hashimoto ..... B24B 29/005 451/194
4,148,108 A * 4/1979 Kamata ..... B24B 41/005 451/194
4,373,297 A * 2/1983 Pennertz ..... B24B 9/002 451/200

(Continued)

*Primary Examiner* — Makena S Markman
(74) *Attorney, Agent, or Firm* — Foley & Lardner LLP

(57) ABSTRACT

A system for buffing a cathode including a lifting assembly, a carriage assembly, and a buffing assembly. The lifting assembly is configured to transport the cathode in a substantially vertical direction while the carriage assembly secures the cathode. The buffing assembly is configured to buff the cathode as the cathode is transported in the substantially vertical direction. The buffing system provides for buffing both sides of a cathode simultaneously.

20 Claims, 7 Drawing Sheets

(56) References Cited

U.S. PATENT DOCUMENTS 4,447,308 A * 5/1984 Willans ..... B24B 7/265
204/279
4,852,198 A * 8/1989 Gebhardt ..... B24B 9/002
29/81.05
5,688,159 A * 11/1997 Kusano ..... B24B 7/17
451/5
5,794,299 A * 8/1998 Gockel ..... H01L 21/67772
15/21.1

* cited by examiner

AUTOMATED CATHODE BUFFING SYSTEM

CROSS-REFERENCE TO RELATED APPLICATIONS

The present application claims priority to U.S. Provisional Patent Application No. 62/783,542, entitled "Automated Cathode Buffing System," filed Dec. 21, 2018 and the contents of which are incorporated herein by reference.

TECHNICAL FIELD

The present invention relates to buffing systems. More particularly, the present invention relates to systems for buffing a cathode for subsequent electro-winning.

BACKGROUND

Electro-winning is a process, similar to electroplating, that uses an electric current to reduce dissolved metal cations to form a thin metal coating on a cathode. Electro-winning is primarily used to change the surface properties of an object (such as abrasion and wear resistance, corrosion protection, lubricity, or aesthetic qualities), and may also be used to increase the thickness of undersized parts. Some conventional materials used for cathodes include copper, titanium, platinum, and steel. Effectively buffing the cathode prior to electro-winning is important in order to create a cathode surface that is smooth and free from irregularities. In one conventional cathode buffing process, the cathode is held horizontally while being buffed on one side, and then the cathode must be turned over to buff the other side. In another conventional cathode buffing process, an orbital buffer is used to buff the cathode in a circular motion, leaving an irregularly buffed surface for electro-winning.

SUMMARY

Various embodiments provide a buffing system. The system includes a frame defining a slot sized and configured to receive a cathode and a lifting assembly secured to the frame and configured to transport the cathode in a substantially vertical direction. The system further includes a carriage assembly coupled to the lifting assembly and configured to secure the cathode during the buffing process. A buffing assembly is rotatably coupled to the frame, the buffing assembly including a motor coupled to a buffing shaft, and a buffing wheel coupled to the buffing shaft. The buffing wheel is configured to buff the cathode as the lifting assembly moves the cathode in the substantially vertical direction.

Additional embodiments provide a system for buffing a cathode. The system includes a frame defining a slot sized and configured to receive a cathode. A lifting assembly is secured to the frame and is configured to transport the cathode in a substantially vertical direction. The lifting assembly includes a first rail assembly and a second rail assembly positioned opposite the first rail assembly. A carriage assembly is positioned between the first rail assembly and the second rail assembly, the carriage assembly sized and configured to secure the cathode during the buffing process. A buffing assembly is configured to buff the cathode.

Still other embodiments provide a buffing system. The system includes a frame defining a slot, the slot sized and configured to receive a cathode. A lifting assembly is secured to the frame and is configured to transport the cathode in a substantially vertical direction. A carriage assembly is slidably coupled to the lifting assembly, the carriage assembly sized and configured to secure the cathode during the buffing process. A buffing assembly includes a pivot shaft rotatably coupled to the frame. A pivot frame is rotatably coupled to the pivot shaft, the pivot frame configured to be positioned by a buffing cylinder. A buffing wheel is rotatably coupled to the pivot frame, the buffing wheel configured to buff the cathode.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1:
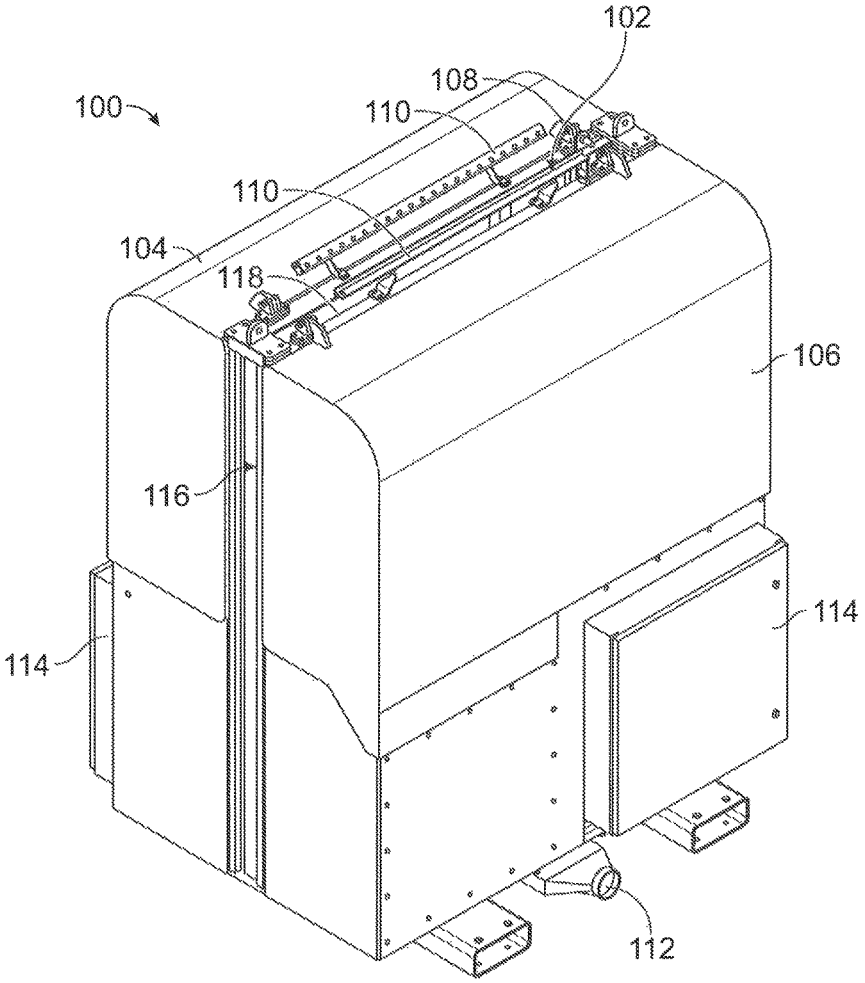
FIG. 1 is a perspective view of a buffing system, according to a particular embodiment.
Figure 2:
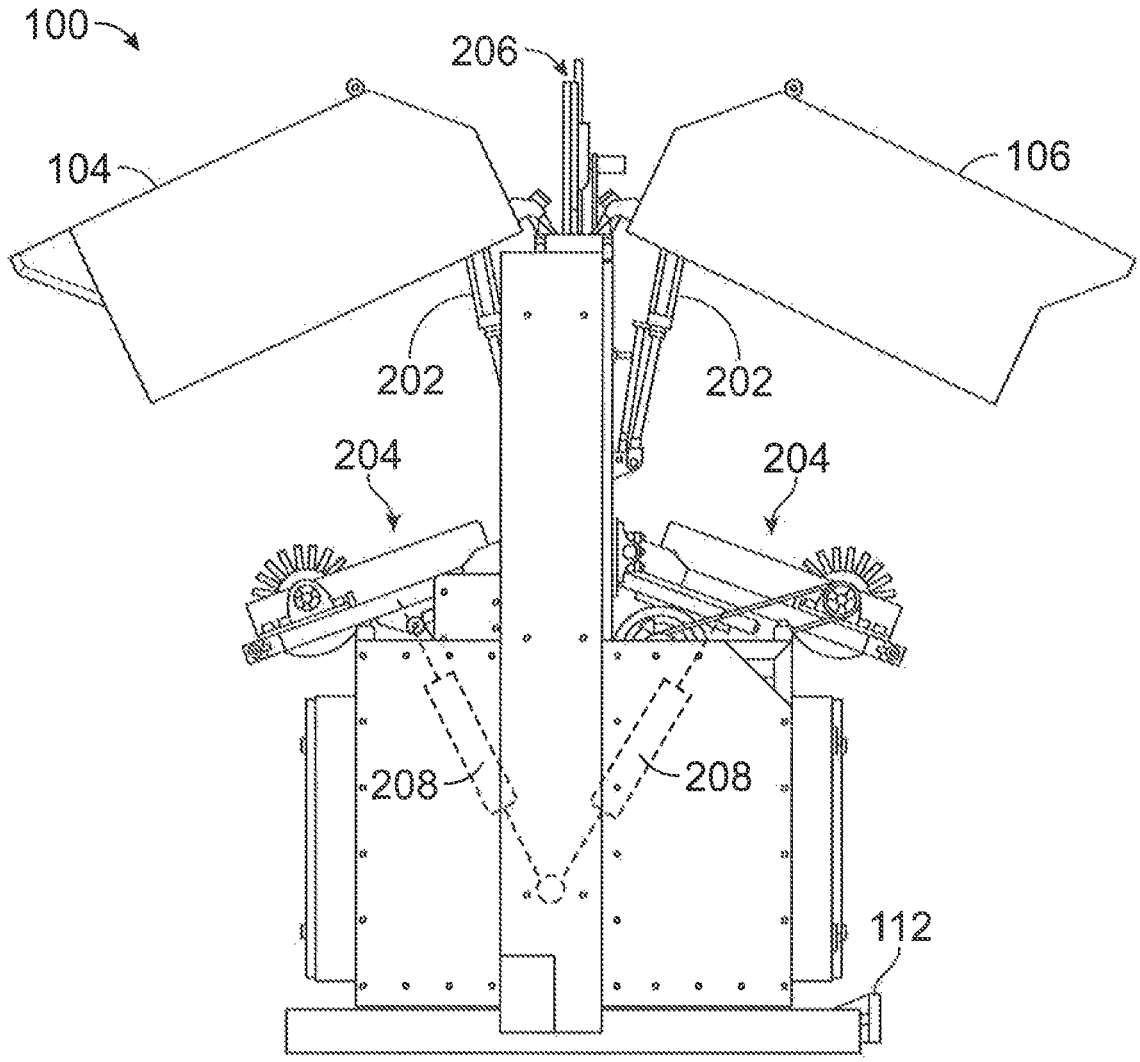
FIG. 2 is a side view of the buffing system of FIG. 1.

FIGS. 1-2 show a perspective view and a side view, respectively, of a buffing system 100, according to a particular embodiment. The buffing system 100 may be used when buffing a cathode in preparation for an electro-winning process. The buffing system 100 includes a lifting assembly 102, a first door 104, a second door 106, a sensor 108, air knives 110, a dust collection adapter 112, an electrical panel 114, a frame 116, cylinders 202, buffing assemblies 204, buffing cylinders 208 and a cathode 206. The lifting assembly 102 further includes a slot 118.

The frame 116 may be constructed of, for example, metallic materials such as stainless steel, aluminum, or other metals suitable for manufacturing. The choice of material may depend on the particular manufacturing environment. The frame 116 is rotatably coupled to the first door 104 and the second door 106 such that the first door 104 and the second door 106 are configured to open to expose the interior of the buffing system 100 for maintenance purposes. The frame 116 is also rotatably coupled to the cylinders 202, the buffing assemblies 204, and the buffing cylinders 208. The frame 116 defines a space allowing the lifting assembly 102 to move within the frame in a substantially vertical direction (e.g., plus or minus five degrees of vertical). The frame 116 is also rigidly coupled to the air knives 110, the sensor 108, and the dust collection adapter 112. The slot 118 is defined by the frame 116 and is sized and configured to receive a cathode 206 for the cathode buffing process.

The first door 104 and the second door 106 may be constructed of, for example, metallic materials such as stainless steel, aluminum, or other metals suitable for manufacturing. The choice of material may depend on the particular manufacturing environment. The first door 104 and the second door 106 are rigidly coupled to the cylinders 202 and are rotatably coupled to the frame 116. The first door 104 and the second door 106 are configured to substantially enclose the buffing system 100 when the buffing system 100 is operating. Enclosing the buffing system 100 during operation prevents injuries, decreases noise, and prevents debris from escaping the buffing system 100. When the first door 104 and the second door 106 are opened, access to the interior of the buffing system 100 is provided such that repairs or regular maintenance activities can be conducted.

The cylinders 202 are rigidly coupled to the first door 104 and the second door 106 and are rotatably coupled to the frame 116. The cylinders 202 may be hydraulic actuators, pneumatic actuators, or any other type of device configured to actuate and provide a force to maintain the first door 104 and the second door 106 in a substantially open configuration.

The sensor 108 is rigidly coupled to the frame 116 and is in electrical communication with the electrical panel 114. The sensor is configured to determine whether the cathode 206 is present in the buffing system 100 and provide information about the presence of the cathode 206 to the electrical panel 114. The sensor may be an optical sensor, a force sensor, or any other sensor that may be configured to detect the presence of the cathode 206 in the buffing system 100.

The air knives 110 are rigidly coupled to the frame 116 and are in electrical communication with the electrical panel 114. The air knives 110 are configured to direct air over the cathode 206 as the cathode 206 is removed from the buffing system 100 to remove any remaining debris on the cathode 206 from the buffing process. The air knives 110 can be air knives, compressed air blowers, or any other type of device capable of removing debris from the cathode 206 as it is removed from the buffing system 100.

The dust collection adapter 112 is rigidly coupled to the frame 116 and is configured to receive the debris from the buffing process. The dust collection adapter 112 may be coupled to a dust removal system that includes a vacuum to transport the debris from the dust collection adapter 112 to the dust removal system.

The electrical panel 114 is rigidly coupled to the frame 116 and is configured to control the buffing system 100. The electrical panel is in electrical communication with the sensor 108, the air knives 110, an operator that may be operating the buffing system 100, and any other electrical equipment included in the buffing system 100. The electrical panel is configured to receive and send electrical signals to control the buffing system 100.

The cathode 206 generally includes a sheet and a header bar coupled to the sheet. The sheet may be any metal suitable for an electro-winning process (e.g., copper, zinc, platinum, etc.). The header bar is an attachment that facilitates cathode cleaning, buffing, and/or electro-winning processes by allowing the cleaning, buffing, and/or electro-winning equipment to manipulate the cathode sheet by the header bar without contacting the cathode sheet with unwanted materials. The slot 118 is sized and configured to fit a plurality of sizes of the cathode 206.

The buffing cylinders 208 are rotatably coupled to the buffing assemblies 204 and are rotatably coupled to the frame 116. The buffing cylinders 208 are sized and configured to raise and lower the buffing assemblies 204. The buffing cylinders 208 may be hydraulic actuators, pneumatic actuators, or any other type of device configured to actuate and provide a force to raise and lower the buffing assemblies 204.

Figure 3:
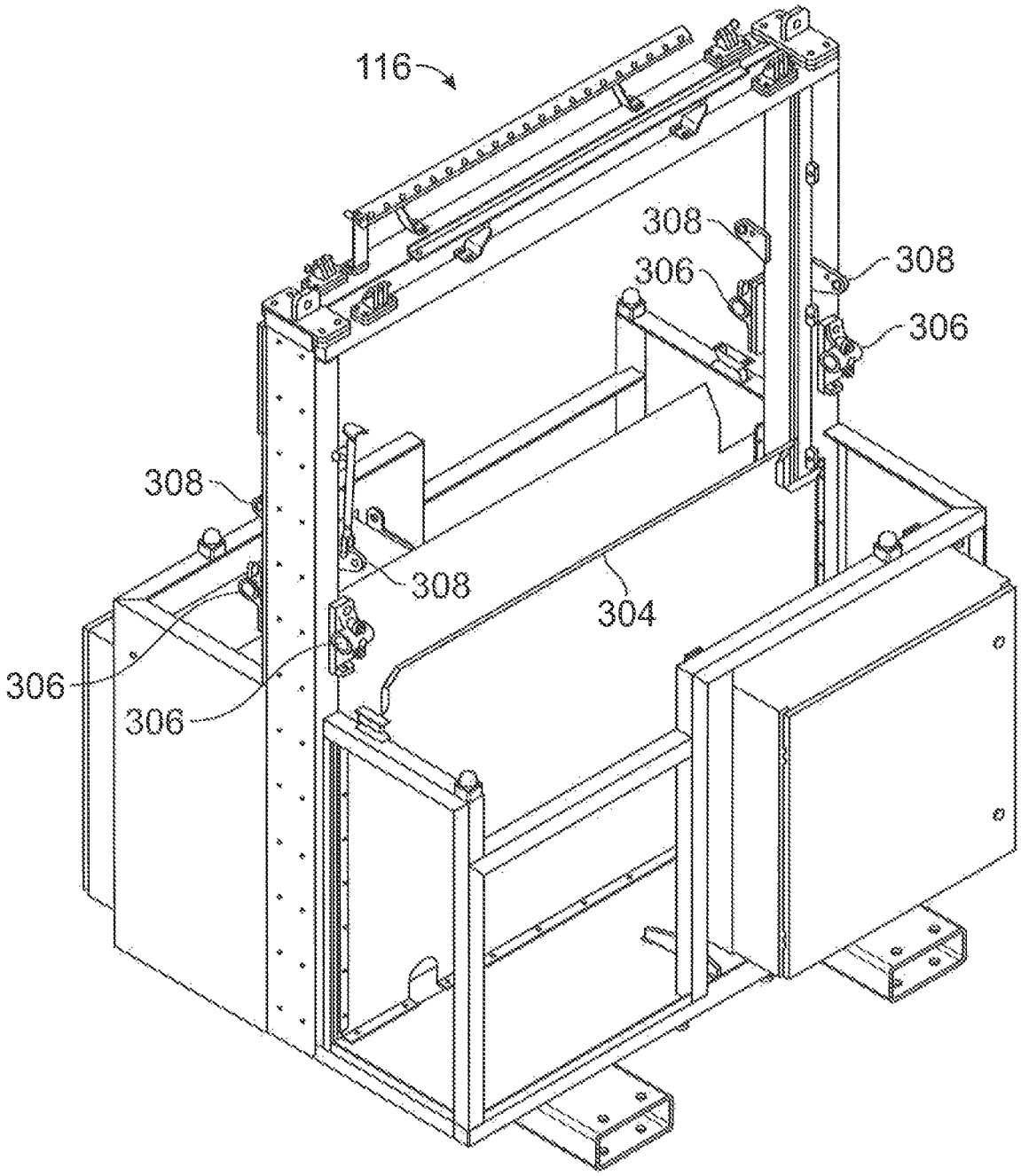
FIG. 3 is a perspective view of a frame of the buffing system of FIG. 1.

FIG. 3 is a perspective view of the frame 116 of the buffing system 100 of FIG. 1. The frame 116 includes a ventilation assembly 304, bearings 306, and bushings 308.

The ventilation assembly 304 is rigidly coupled to the frame 116 and may be constructed of, for example, metallic materials such as stainless steel, aluminum, or other metals suitable for manufacturing. The ventilation assembly 304 may also be constructed of, for example, plastic materials such as polycarbonate, ABS, or other plastics suitable for manufacturing. The ventilation assembly 304 is sized and configured to receive the lifting assembly 102 and receive debris generated during the buffing process. The ventilation assembly will be further described with reference to FIG. 6.

The bearings 306 are rigidly coupled to the frame 116 and are sized and configured to receive the buffing assemblies 204 such that the buffing assemblies 204 can rotate with respect to the frame 116. The bushings 308 are rigidly coupled to the frame 116 and are sized and configured to rotatably couple to the cylinders 202 such that the cylinders 202 can rotate with respect to the frame 116.

Figure 4A:
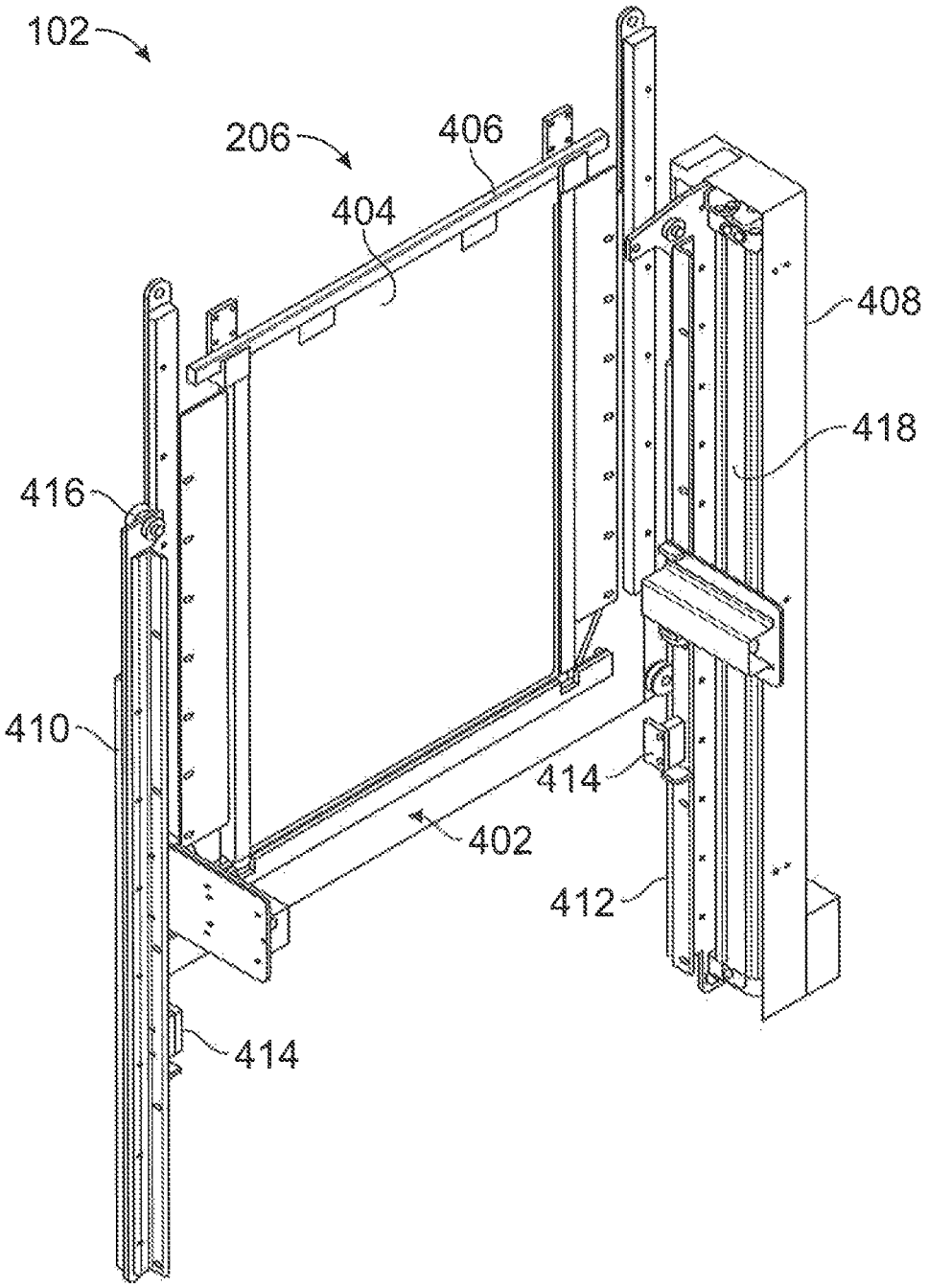
FIG. 4A is a perspective view of a lifting assembly of the buffing system of FIG. 1.
Figure 4B:
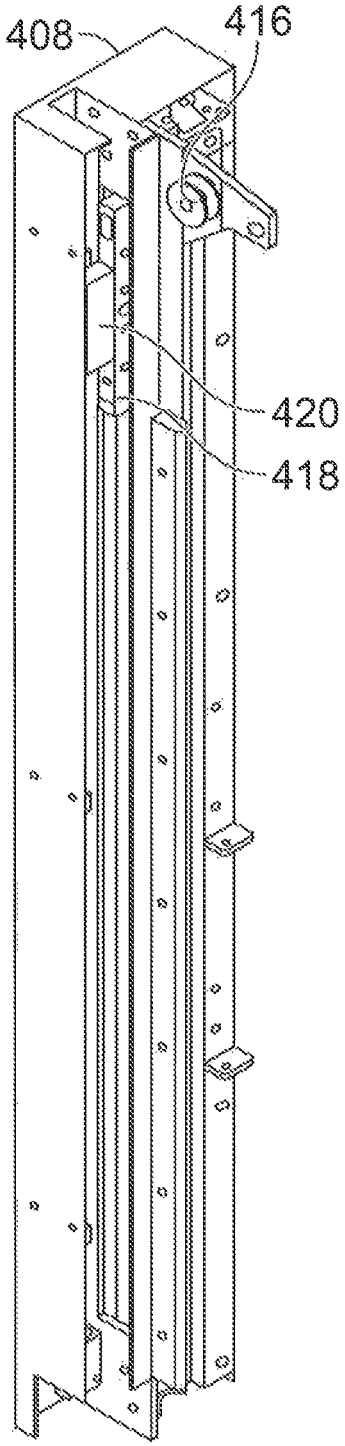
FIG. 4B is a perspective view of a rail assembly of the lifting assembly of FIG. 4A.

FIGS. 4A-B are perspective views of the lifting assembly 102 of the buffing system 100 of FIG. 1. The lifting assembly 102 is configured to transport the cathode 206 in the substantially vertical direction to facilitate the buffing process. The lifting assembly 102 includes a carriage assembly 402, a cathode sheet 404, a header bar 406, a rail assembly 408, and a rail assembly 410. The rail assembly 408 includes a cam rail 412, a stop 414, a follower 416, an actuator 418, and an actuator tab 420. The rail assembly 410 includes a cam rail 412, a stop 414, and a follower 416.

The header bar 406 is coupled to the cathode sheet 404 and is sized and configured to secure the cathode sheet 404 such that the cathode sheet 404 can be inserted into, and be removed from, the buffing system 100. The header bar 406 may be constructed of any material suitable for supporting the cathode 206. In some embodiments, the header bar 406 is sized and configured to support the cathode 206 when it is inserted into the buffing system 100 by an operator. In some embodiments, the header bar 406 is sized and configured to support the cathode 206 when it is inserted into the buffing system 100 by a robot or other automated means.

The rail assembly 408 and the rail assembly 410 are rigidly coupled to the frame 116. The rail assembly 408 and the rail assembly 410 may be constructed of, for example, metallic materials such as stainless steel, aluminum, or other metals suitable for manufacturing. Cam rails 412 and followers 416 are sized and configured to be linearly coupled to the carriage assembly 402 to provide for the substantially vertical travel of the carriage assembly 402. The stops 414 are rigidly coupled to the rail assembly 408 and the rail assembly 410 and are configured to set a fixed position and to prevent the carriage assembly 402 from an uncontrolled fall in case of a failure of the buffing system 100.

The actuator 418 is rigidly coupled to the actuator tab 420 and is sized and configured to transport the carriage assembly 402 in a substantially vertical direction. The actuator 418 may be a hydraulic, pneumatic, electric, thermal, magnetic, or any other type of actuator capable of moving in a substantially vertical direction.

The actuator tab 420 is rigidly coupled to the actuator 418 and is sized and configured to contact the carriage assembly 402 such that when the actuator 418 moves in a substantially vertical direction, the actuator tab 420 moves the carriage assembly in the vertical direction. The interaction between the actuator tab 420 and the carriage assembly 402 will be further described with reference to FIG. 5.

The carriage assembly 402 is sized and configured to receive the cathode 206 when the cathode 206 is secured by header bar supports and is transported in the substantially vertical direction by the lifting assembly 102. The carriage assembly 402 will be further described with reference to FIG. 5.

Figure 5:
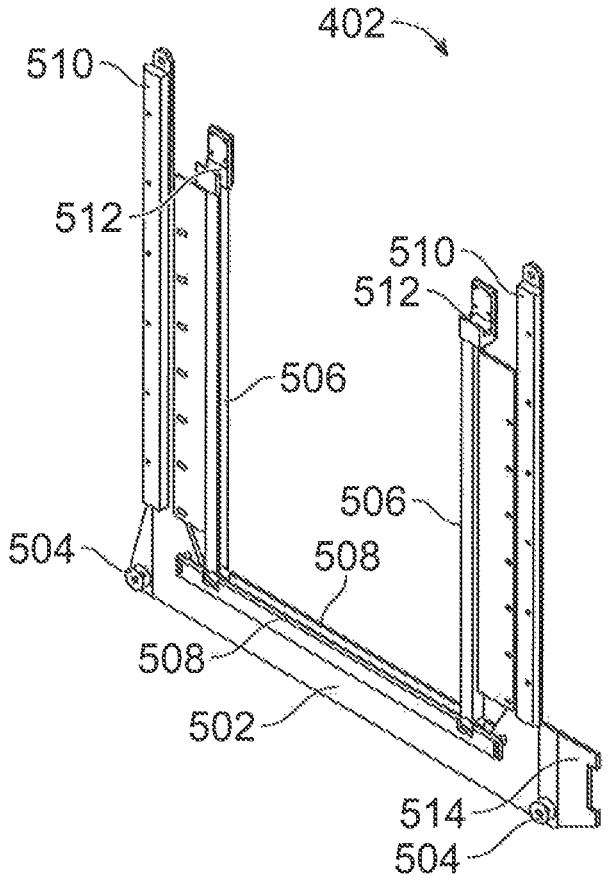
FIG. 5 is a perspective view of a carriage assembly of the buffing system of FIG. 1.

FIG. 5 is a perspective view of the carriage assembly 402 of the buffing system 100 of FIG. 1. The carriage assembly 402 is linearly coupled to the lifting assembly 102 such that the lifting assembly 102 transports the carriage assembly 402 in the substantially vertical direction. The carriage assembly 402 includes a frame 502, followers 504, edge guards 506, strip guards 508, cam rails 510, header bar supports 512, and an actuator slot 514.

The frame 502 may be constructed of, for example, metallic materials such as stainless steel, aluminum, or other metals suitable for manufacturing. The frame 502 is rigidly coupled to the edge guards 506, the strip guards 508, the cam rails 510, the header bar supports 512, and the actuator slot 514. The frame 502 is rotatably coupled to the followers 504.

The edge guards 506 are sized and configured to receive the cathode 206 and maintain the cathode 206 in a substantially vertical orientation. The edge guards 506 define a space configured to receive vertical edges of the cathode 206 such that the cathode 206 is prevented from rotation about a vertical axis.

The strip guards 508 are sized and configured to receive the cathode 206 and maintain the cathode 206 in a substantially vertical orientation. The strip guards 508 define a space configured to receive a bottom edge of the cathode 206 such that if required the cathode 206 is prevented from rotation about a horizontal axis.

The header bar supports 512 are sized and configured to receive the header bar 406 and maintain the cathode sheet 404 in a substantially vertical orientation. The header bar supports 512 define a space configured to receive the header bar 406 such that the cathode sheet 404 is prevented from rotation about a horizontal axis.

The cam rails 510 are sized and configured to be linearly coupled to the followers 416 such that, as the carriage assembly 402 moves in a substantially vertical direction, the followers 416 rotate as the cam rails 510 move with the carriage assembly 402. The followers 416 are also sized and configured to maintain the carriage assembly 402 in a substantially vertical orientation.

The followers 504 are sized and configured to be linearly coupled to the cam rails 412 such that, as the carriage assembly 402 moves in a substantially vertical direction, the followers 504 rotate along the cam rails 412 as the carriage assembly 402 moves.

The actuator slot 514 is a cutout in the carriage assembly 402 that is sized and configured to fit around the actuator tab 420 such that movement of the actuator tab 420 results in movement of the carriage assembly 402.

Figure 6:
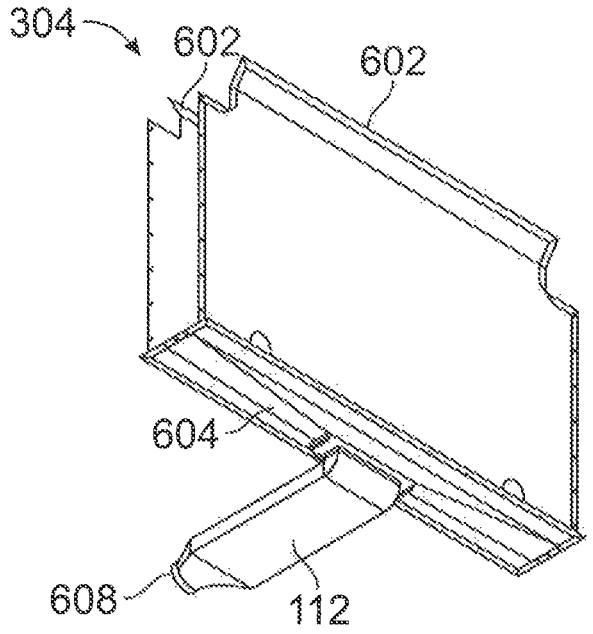
FIG. 6 is a perspective view of a ventilation assembly of the buffing system of FIG. 1.

FIG. 6 is a perspective view of the ventilation assembly 304 of the buffing system 100 of FIG. 1. The ventilation assembly 304 may be constructed of, for example, metallic materials such as stainless steel, aluminum, or other metals suitable for manufacturing. The ventilation assembly 304 is rigidly coupled to the frame 116 and is configured to collect and provide for removal of debris that may accumulate during a buffing process. The ventilation assembly 304 includes a collection wall 602, a collection funnel 604, the dust collection adapter 112, and a collection outlet 608.

The collection wall 602 is configured to contact debris that may be generated from the buffing process. The collection wall 602 is angled such that the debris that contacts the collection wall 602 will be directed toward the collection funnel 604 at the bottom of the ventilation assembly 304. The collection funnel 604 is configured to further direct the debris from the collection wall 602 into the dust collection adapter 112.

The collection outlet 608 is configured to couple with a debris removal system designed to remove the debris from the ventilation assembly 304. In some embodiments, the debris removal system may include a vacuum to pull the debris from the ventilation assembly 304 into the debris removal system.

Figure 7:
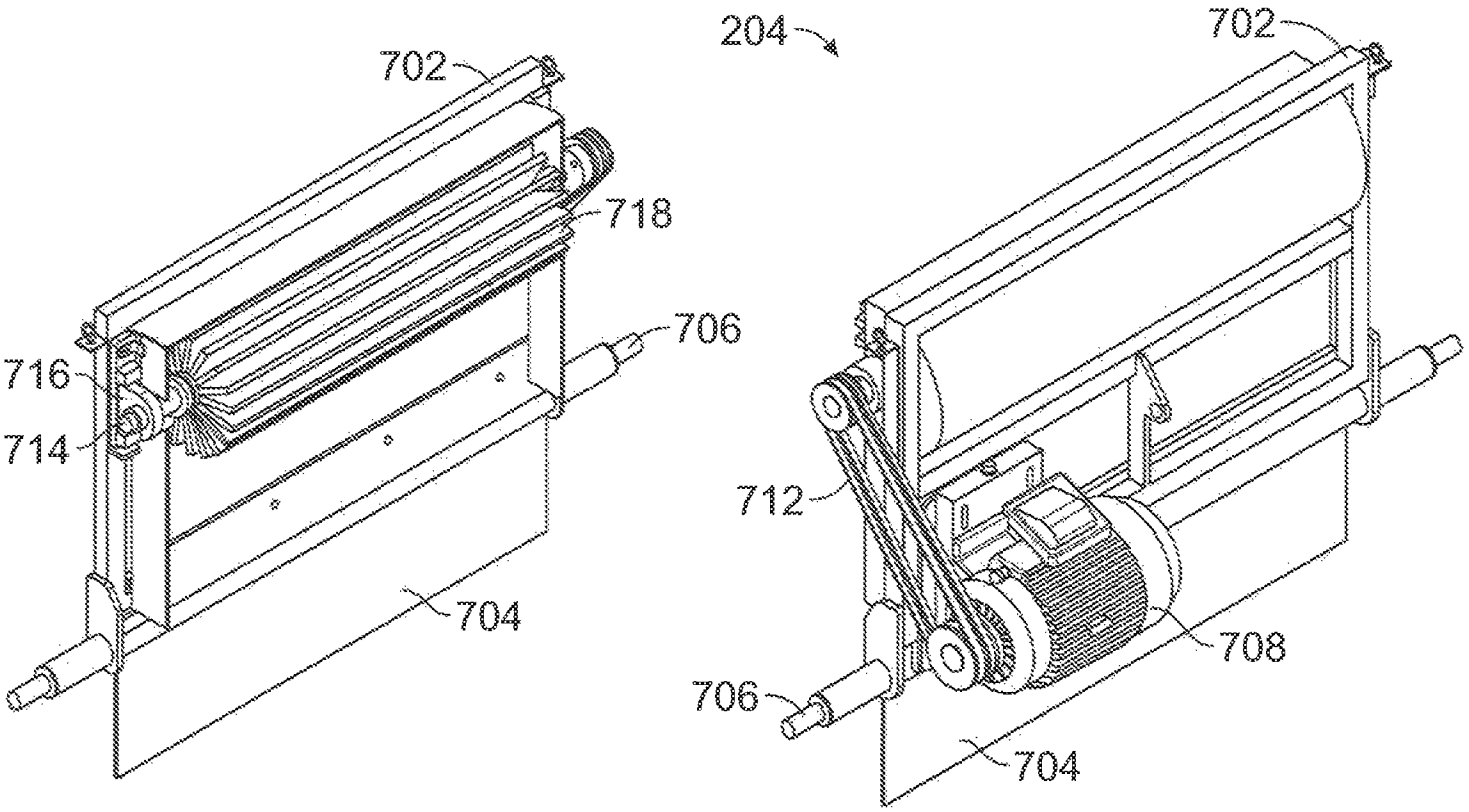
FIG. 7 are illustrations of various perspective views of a buffing assembly of the buffing system of FIG. 1.

FIG. 7 is an illustration of various perspective views of a buffing assembly 204 of the buffing system 100 of FIG. 1. The buffing assembly 204 is configured to mechanically buff the surface of the cathode 206 and create a smooth surface on the cathode 206 that is suitable for subsequent electrowinning. The buffing assembly 204 includes a frame 702, a dust flap 704, a pivot shaft 706, a motor 708, a belt 712, a buffing shaft 714, a bearing 716, and a buffing wheel 718.

The frame 702 may be constructed of, for example, metallic materials such as stainless steel, aluminum, or other metals suitable for manufacturing. The frame 702 is rigidly coupled to the dust flap 704, the pivot shaft 706, the motor 708, and the bearing 716. The frame 702 is also rigidly coupled to the buffing cylinder 208.

The dust flap 704 is coupled to the frame 702 and is configured to direct dust and debris from the buffing process to the ventilation assembly 304. The dust flap 704 may be constructed of, for example, metallic materials such as stainless steel, aluminum, or other metals suitable for manufacturing. The dust flap 704 may also be constructed of, for example, plastic materials such as polycarbonate, ABS, or other plastics suitable for manufacturing. The dust flap 704 may also be constructed of, for example, rubber materials such as natural rubber, synthetic rubber, vulcanized rubber, or other rubbers suitable for manufacturing.

The pivot shaft 706 is coupled to the frame 702 and is configured to couple with the bearings 306 on frame 116 such that the pivot shaft 706 rotates in the bearings 306. The pivot shaft 706 rotates in the bearings 306 when the buffing cylinders 208 impart a force to the frame 702, causing the frame 702, and thus the pivot shaft 706, to rotate. The pivot shaft 706 may be constructed of, for example, metallic materials such as stainless steel, aluminum, or other metals suitable for manufacturing.

The motor 708 is coupled to the frame 702 and is rotatably coupled to the buffing shaft 714, and is configured to rotate the buffing wheel 718 such that the buffing wheel 718 buffs the cathode 206. The motor 708 may be an electric motor, a pneumatic motor, or any other type of motor capable of rotating the buffing wheel 718 to buff the cathode 206.

The belt 712 is coupled to the motor 708 and the buffing shaft 714 such that the rotational motion from the motor 708 is transmitted to the buffing shaft 714. The belt 712 may be constructed from a rubber or other elastic material, or any other type of material capable of transmitting rotational motion from the motor 708 to the buffing shaft 714.

The buffing shaft 714 is rotationally coupled to the bearing 716 and the belt 712, and rigidly coupled to the buffing wheel 718. The buffing shaft 714 is configured to rotate based on motion of the belt 712 and transmit the motion to the buffing wheel 718 to cause the buffing wheel 718 to rotate. The buffing shaft 714 may be constructed of, for example, metallic materials such as stainless steel, aluminum, or other metals suitable for manufacturing.

The bearing 716 is rigidly coupled to the frame 702 and is rotatably coupled to the buffing shaft 714. The bearing 716 may be constructed of, for example, metallic materials such as stainless steel, aluminum, or other metals suitable for manufacturing. The bearing 716 is configured to allow the buffing shaft 714 to rotate and transmit the rotation to the buffing wheel 718.

The buffing wheel 718 is rigidly coupled to the buffing shaft 714 and is configured to rotate based on the rotational motion of the buffing shaft 714. The buffing wheel 718 is further configured to contact the cathode 206 while the buffing wheel 718 is rotating such that the cathode 206 is buffed by the buffing wheel 718 to prepare the cathode 206 for electro-winning. The buffing wheel may be constructed of any material capable of effectively buffing the cathode 206 without damaging the cathode 206. In some implementations, the buffing wheel 718 can buff the cathode 206 without using any additional buffing media. In other implementations, the buffing wheel 718 is used in conjunction with buffing media to buff the cathode 206. Some non-limiting examples of buffing media include aluminum oxide, chromium oxide, and iron oxide.

Throughout the description above, many elements were described as singular elements. However, as shown in FIG. 2, it is understood that the buffing system 100 includes two sides such that the cathode 206 can be buffed on two sides at the same time. Thus, in instances in which only a single element was described above, it is understood that more than one element may be present in the buffing system 100.

In operation, and with reference to FIGS. 1-7, a cathode 206 must be buffed prior to being used in an electro-winning process. To properly buff the cathode 206 using the buffing system 100, the cathode 206 is lowered through the slot 118 until the header bar 406 contacts the header bar supports 512. In some instances, a user will lower the cathode 206 into the slot 118. In other instances, a robot or other automated process will lower the cathode 206 into the slot 118.

As the cathode 206 is lowered into the slot 118, the vertical edges of the cathode 206 are within the edge guards 506. When the cathode 206 has been fully lowered into the slot 118 and the header bar 406 is resting on the header bar supports 512, the bottom edge of the cathode sheet 404 is located within the strip guard 508. Once placed into the buffing system 100 as described, the cathode sheet 404 is held in a substantially vertical orientation and is prevented from rotating in any direction.

In some embodiments, to initiate the buffing process a user will press a button. In other embodiments, the buffing process will be initiated when the sensor 108 senses that a cathode 206 is in the appropriate position for the process to begin.

When the buffing process begins, the electrical panel 114 sends an electrical signal to both the actuator 418 and the motors 708. When the motors 708 receive the electrical signal, the motors 708 begin to rotate and the buffing cylinders 208 lift the frame 702 such that the buffing wheels 718 contact the cathode 206 to begin the buffing process.

The buffing wheels 718 are sized and configured to buff the entire width of the cathode 206 during the buffing process to eliminate the need for the buffing wheels to move in both the horizontal and vertical directions.

As the buffing process continues, the actuator 418 moves in the vertical direction. As the actuator 418 moves in the vertical direction, the actuator 418 contacts the actuator slot 514 such that, as the actuator 418 moves the carriage assembly 402 moves. Thus, as the actuator 418 moves up and down in the vertical direction, the carriage assembly 402 moves up and down in the vertical direction and causes the buffing wheels 718 to buff both sides of the cathode 206 along its entire length and width.

Throughout the buffing process, debris may be created either by the buffing media or impurities or surface imperfections that have been buffed off the cathode 206 by the buffing wheels 718. The debris is directed downward toward the ventilation assembly 304 based on the rotation of the buffing wheels 718. The debris is then directed further downward by the dust flaps 704 and into the collection wall 602. From the collection wall 602, the debris is directed toward the collection funnel 604 where the debris falls into the dust collection adapter 112. The dust removal system then uses a vacuum to remove the debris from the buffing system 100.

When the buffing process is complete, the cathode 206 is removed from the slot 118 by a user, in some implementations. In other implementations, the cathode 206 is removed from the slot 118 by a robot or other automated process. While the cathode 206 is removed from the slot 118, the air knives 110 direct pressurized air at the cathode 206 to remove any other remaining debris from the cathode 206. The pressurized air is directed downward such that any other debris is collected by the dust removal system.

After completion, it may be necessary to repair the buffing system 100 or otherwise perform preventive maintenance. To do so, the first door 104 and the second door 106 are lifted up, and as the first door 104 and the second door 106 are lifted up the cylinders 202 maintain the first door 104 and the second door 106 in the open position. In addition, the buffing assemblies 204 can be moved away from their buffing positions by rotating the buffing assemblies 204 downward by retracting the buffing cylinders 208, causing the pivot shaft 706 to rotate within the bearing 306.

After repairs or preventive maintenance is complete, the buffing assemblies 204 are returned to their upright positions by rotating the buffing assemblies 204 upward. The first door 104 and the second door 106 are then lowered back to their original positions to put the buffing system 100 in condition for subsequent buffing processes.

As utilized herein, the terms "substantially" and similar terms are intended to have a broad meaning in harmony with the common and accepted usage by those of ordinary skill in the art to which the subject matter of this disclosure pertains. It should be understood by those of ordinary skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "top," "bottom," "upper," "above," "below," etc.) are merely used to describe the orientation of various elements in the Figures. It should be noted that the orientation of various elements may differ according to other exemplary embodiments, and that such variations are intended to be encompassed by the present disclosure.

Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter described herein. For example, elements shown as integrally formed may be constructed of multiple components or elements, the position of elements may be reversed or otherwise varied, and the nature or number of discrete elements or positions may be altered or varied. The order or sequence of any method processes may be varied or re-sequenced according to alternative embodiments. Other substitutions, modifications, changes, and omissions may also be made in the design, operating conditions and arrangement of the various exemplary embodiments without departing from the scope of the present invention.

What is claimed is:

1. A buffing system, comprising:

a frame defining a slot, the slot sized and configured to receive a cathode;

a lifting assembly secured to the frame and configured to transport the cathode in a substantially vertical direction;

a carriage assembly slidably coupled to the lifting assembly, the carriage assembly comprising a carriage follower and a carriage cam rail, the carriage follower in slidable communication with a lifting cam rail and the carriage cam rail in slidable communication with a lifting follower, and wherein the carriage assembly is sized and configured to secure the cathode during a buffing process; and a buffing assembly rotatably coupled to the frame, the buffing assembly comprising:

a motor rigidly coupled to a pivot frame, the motor rotatably coupled to a buffing shaft; and a buffing wheel rigidly coupled to the buffing shaft, the buffing wheel configured to buff the cathode as the motor operates and as the lifting assembly transports the cathode in the substantially vertical direction.

2. The buffing system of claim 1, further comprising:

a ventilation assembly sized and configured to collect dust from the buffing process, the ventilation assembly comprising:

a dust collection wall configured to receive particles from the buffing process;

a dust collection funnel configured to direct the particles to a dust collection adapter; and a dust collection outlet in communication with the dust collection adapter, the dust collection outlet in fluid communication with a dust collection system configured to collect the particles from the buffing process.

3. The buffing system of claim 1, further comprising:

a header bar support sized and configured to receive a header bar, the header bar coupled to the cathode, the cathode comprising a cathode sheet;

a strip guard sized and configured to slidably receive the cathode sheet, the strip guard further configured to secure a side of the cathode sheet; and an edge guard sized and configured to slidably receive the cathode sheet, the edge guard further configured to secure an end of the cathode sheet.

4. The buffing system of claim 1, wherein:

the lifting assembly comprises the lifting cam rail and the lifting follower.

5. The buffing system of claim 1, wherein the buffing assembly comprises:

a pivot shaft rotatably coupled to a bearing, the bearing coupled to the frame, the pivot frame rigidly coupled to the pivot shaft.

6. The buffing system of claim 1, further comprising:

a door rotatably coupled to the frame, the door further coupled to a cylinder, the cylinder coupled to a bushing, the cylinder configured to selectively maintain the door in an open position.

7. A system for buffing a cathode, comprising:

a frame defining a slot, the slot sized and configured to receive a cathode;

a lifting assembly secured to the frame and configured to transport the cathode in a substantially vertical direction, the lifting assembly comprising:

a first rail assembly; and a second rail assembly positioned opposite the first rail assembly;

a carriage assembly positioned between the first rail assembly and the second rail assembly, the carriage assembly comprising a first carriage follower and a first carriage cam rail, the first carriage follower in slidable communication with a first lifting cam rail and the first carriage cam rail in slidable communication with a first lifting follower, and wherein the carriage assembly is sized and configured to secure the cathode during a buffing process; and a buffing assembly configured to buff the cathode.

8. A system for buffing a cathode, comprising:

a frame defining a slot, the slot sized and configured to receive a cathode;

a lifting assembly secured to the frame and configured to transport the cathode in a substantially vertical direction, the lifting assembly comprising:

a first rail assembly, wherein the first rail assembly comprises:

a first cam rail;

a first stop positioned on the first cam rail;

a first follower positioned above the first stop;

an actuator movably coupled to the first cam rail, the actuator positioned between the first stop and the first follower;

a second cam rail;

a second stop positioned on the second cam rail, the second stop positioned opposite the first stop; and a second follower positioned above the second stop; and a second rail assembly positioned opposite the first rail assembly;

a carriage assembly positioned between the first rail assembly and the second rail assembly, the carriage assembly sized and configured to secure the cathode during a buffing process; and a buffing assembly configured to buff the cathode.

9. The system of claim 8, wherein the carriage assembly further comprises:

a carriage frame;

a first carriage cam rail extending from the carriage frame, the first carriage cam rail configured to interface with the first follower;

a second carriage cam rail extending from the carriage frame, the second carriage cam rail positioned opposite the first carriage cam rail and configured to interface with the second follower;

a first carriage follower positioned on the first carriage cam rail, the first carriage follower configured to interface with the first cam rail; and a second carriage follower positioned on the second carriage cam rail, the second carriage follower configured to interface with the second cam rail.

10. The system of claim 9, further comprising an actuator tab coupled to the actuator and protruding from the first cam rail.

11. The system of claim 10, further comprising an actuator slot defined by the first carriage cam rail, the actuator slot configured to interface with the actuator tab.

12. The system of claim 8, further comprising:

a first edge guard coupled to a carriage frame, the first edge guard configured to receive a first vertical edge of the cathode; and a second edge guard coupled to the carriage frame, the second edge guard configured to receive a second vertical edge of the cathode.

13. The system of claim 12, further comprising:

a first header bar support coupled to the first edge guard, the first header bar support configured to receive a header bar coupled to the cathode; and a second header bar support coupled to the second edge guard, the second header bar support configured to receive the header bar.

14. The system of claim 13, further comprising a strip guard coupled to the carriage frame, the strip guard configured to receive a bottom edge of the cathode.

15. A buffing system, comprising:

a frame defining a slot, the slot sized and configured to receive a cathode;

a lifting assembly secured to the frame and configured to transport the cathode in a substantially vertical direction;

a carriage assembly slidably coupled to the lifting assembly, the carriage assembly comprising a carriage follower and a carriage cam rail, the carriage follower in slidable communication with a lifting cam rail and the carriage cam rail in slidable communication with a lifting follower, and wherein the carriage assembly is sized and configured to secure the cathode during a buffing process; and a buffing assembly comprising:

a pivot shaft rotatably coupled to the frame;

a pivot frame rotatably coupled to the pivot shaft, the pivot frame configured to be positioned by a buffing cylinder; and a buffing wheel rotatably coupled to the pivot frame, the buffing wheel configured to buff the cathode.

16. The system of claim 15, further comprising:

a motor rigidly coupled to a first side of the pivot frame;

a buffing shaft coupled to the motor by a belt, the buffing shaft positioned on a second side of the pivot frame, the buffing shaft configured to rotate as the belt moves in response to rotational motion of the motor.

17. The system of claim 16, wherein the buffing wheel is rigidly coupled to the buffing shaft to enable transmission of rotational motion of the motor to the buffing wheel.

18. The system of claim 17, further comprising a dust flap coupled to the pivot frame and positioned below the buffing wheel, the dust flap configured to direct debris toward a collection wall.

19. The system of claim 17, wherein the buffing cylinder is configured to position the buffing wheel such that the buffing wheel contacts the cathode while the buffing wheel is rotating.

20. The system of claim 19, further comprising a buffing media releasably coupled to the buffing wheel, the buffing media configured to contact the cathode when the buffing wheel contacts the cathode.

* * * * *